US007169315B1

(12) United States Patent
Furneaux et al.

(10) Patent No.: US 7,169,315 B1
(45) Date of Patent: Jan. 30, 2007

(54) METHOD OF PRODUCING AN ALUMINIUM SURFACE WITH A HIGH TOTAL REFLECTANCE

(75) Inventors: Robin Christopher Furneaux, Banbury (GB); Barry Roy Ellard, Northants (GB)

(73) Assignee: Novelis, Inc., Toronto (CA)

( * ) Notice: Subject to any disclaimer, the term of this patent is extended or adjusted under 35 U.S.C. 154(b) by 0 days.

(21) Appl. No.: 10/111,340

(22) PCT Filed: Nov. 6, 2000

(86) PCT No.: PCT/GB00/04254

§ 371 (c)(1),
(2), (4) Date: Feb. 6, 2004

(87) PCT Pub. No.: WO01/32959

PCT Pub. Date: May 10, 2001

(30) Foreign Application Priority Data

Nov. 4, 1999 (EP) ..... 99308791

(51) Int. Cl.
*B29D 11/00* (2006.01)
*C23F 1/00* (2006.01)

(52) U.S. Cl. ..... 216/24; 216/96; 216/100; 216/102; 216/103; 252/79.1; 252/79.2

(58) Field of Classification Search ..... 216/96, 216/100, 102, 103, 24; 252/79.1, 79.2
See application file for complete search history.

(56) References Cited

U.S. PATENT DOCUMENTS

| | | | | |
|---|---|---|---|---|
| 2,847,286 A | | 8/1958 | Neunzig et al. | |
| 4,247,378 A | | 1/1981 | Harris | |
| 4,483,750 A | * | 11/1984 | Powers et al. | 205/116 |
| 4,714,528 A | * | 12/1987 | Takeuchi et al. | 205/153 |
| 4,762,638 A | * | 8/1988 | Dollman et al. | 510/254 |
| 5,663,001 A | * | 9/1997 | Textor et al. | 428/469 |

FOREIGN PATENT DOCUMENTS

| | | |
|---|---|---|
| DE | 973243 | 12/1959 |
| EP | 0143715 | 6/1985 |
| GB | 718024 | 11/1954 |
| GB | 740880 | 11/1955 |
| GB | 1136588 | 12/1968 |
| WO | WO99/13133 | 3/1999 |

OTHER PUBLICATIONS

English language Abstract of Japanese Patent Publication No. 05 112900 published May 7, 1993, Patent Abstracts of Japan, vol. 17, No. 468 published Aug. 26, 1993.

* cited by examiner

*Primary Examiner*—Shamim Ahmed
(74) *Attorney, Agent, or Firm*—Cooper & DunhamLLP

(57) ABSTRACT

A method of producing a reflector sheet, which method comprises treating an Al alloy sheet to increase the total reflectance of a surface of the sheet for use as a lighting reflector by bringing the sheet into contact with an acid or alkaline fluid that dissolves aluminium metal, said fluid having a viscosity of less than 0.01 Pa·s, under conditions to remove from 10 nm to 2000 nm of metal from the surface, and cutting or forming the treated Al alloy sheet into the shape of a reflector sheet.

8 Claims, No Drawings

METHOD OF PRODUCING AN ALUMINIUM SURFACE WITH A HIGH TOTAL REFLECTANCE

This invention is concerned with a method of treating an aluminium alloy sheet having a surface to increase the total reflectance of that surface. Total reflectance is an important property for lighting reflector sheet. Total reflectance is the proportion of light that is reflected from rather than absorbed by the sheet surface. The manufacturers of lighting products want high total reflectance because that represents good energy efficiency. On the other hand, high or low specularity products may be preferred depending on function. For a highly specular surface, a high proportion of the incident light is reflected at the same angle as the angle of incidence. Low specularity or highly diffuse reflectance involves light reflected over a wide range of angles. Often rather matt surfaces are favoured and terms such as "reflectormatt" and "semi-specular" are used to describe current products with a perceived optimum level of diffuse reflectance.

After silver, pure aluminium has an outstandingly high intrinsic total reflectance property. The total reflectance of aluminium alloys is generally lower than of the pure metal by an amount related to the concentration of the alloying ingredients. Pure aluminium metal and dilute aluminium alloys (typically 99.8% Al or purer, for example AA1080) can be bright rolled to give surfaces having excellent total reflectance. But pure aluminium has poor mechanical properties, and bright rolling is relatively expensive and necessarily results in sheet having a highly specular surface. There is a need for production routes to achieve surfaces having correspondingly high total reflectance, but using more concentrated aluminium alloys having better mechanical properties, and using rolling conditions that are less critical.

These needs have been addressed by production techniques that involve chemical etching and/or electrochemical polishing. Chemical and electrochemical polishing and brightening techniques involve the use of viscous solutions based on concentrated phosphoric acid, and they result in removal of metal from the surface, to a depth of more than 1 μm and typically of around 10 μm. The high viscosity appears necessary in order to achieve a static fluid film adjacent the surface by means of which the surface is flattened. Such techniques are described in WO 99/13133 and WO 99/13134. A viscous chemical brightening solution based on concentrated phosphoric acid is marketed under the trade mark Phosbrite 159. But the use of such viscous solutions is undesirable, for they are difficult to remove rapidly from a surface in a manner consistent with high-speed treatment of that surface. The removal of many microns of metal from the surface is also undesirable, for it is expensive in power and chemicals, it creates effluent problems, it thins and weakens the sheet being treated, and has other disadvantages as discussed below.

WO-A-9913133 describes the removal or reduction of directionality or anisotropy from aluminium surfaces which involves a two-step process of chemical etching and electrochemical polishing. A total process time of over 60 seconds is disclosed. In addition, the solutions used in the process have a high viscosity and concentration which would cause problems with drag-out. The process described would remove a significant amount of metal from the surface.

A thesis by Inger Lindseth of the Norwegian University of Science and Technology (published 16 Nov. 1999) entitled "Optical Total Reflectance, Near-Surface Microstructure, and Topography of Rolled Aluminium Materials" discloses etching of aluminium alloys and investigates the total reflectance of industrially cold rolled and etched materials. 85% phosphoric acid solution is used as the etching solution, which has a relatively high viscosity.

Symposium II—Surface and Near-Surface Analysis of Materials, June 1998, pages 49 ff ($9^{th}$ Cimtec—World Forum on New Materials) relates to an investigation on how the surface topography and microstructure of different aluminium surfaces affect the total reflectance of light. The AA1070 alloy is cold rolled commercially and then mechanically polished and electropolished. The paper teaches the improvement of Total Reflectance by removing the highly deformed surface layer. In addition, a batch process is disclosed.

A number of documents have investigated effects on Specular Reflectivity, in contrast to Total Reflectivity. These include U.S. Pat. No. 4,247,378 and GB-A-740880. There is a distinction between total reflectance, specular reflectance and diffuse reflectance. Total reflectance is used to describe the total amount of light reflected from a surface, as opposed to that light which is absorbed by the surface upon which it falls and slightly warms the surface by being absorbed. It is expressed as a percentage of the incident light intensity. To measure total reflectance it is therefore necessary to try and capture the reflected light at every possible angle of reflection. In practice, this is typically done by using an integrating sphere. The sphere has a small aperture in its base that is placed against the surface to be measured and two other apertures; one for introducing a beam of light and one for measuring the integrated sum of the reflected light. The surfaces of such spheres are made of a highly reflecting substance such as barium sulphate to ensure that they do not contribute to the measured absorption. After the beam of light has struck the surface to be measured it is reflected within the sphere and, regardless of the angle it was reflected at, eventually detected and absorbed by the measuring device. By comparing the intensity of light measured at the detector when the sample aperture is plugged with the same material as the inner wall of the sphere and when the beam is reflected off the sample surface the total reflectivity, or percentage absorption, can be determined.

Specular reflectance is used to describe the mirror-like properties of a surface. For a completely specular surface all the light that is reflected, and not absorbed, is reflected at an angle of reflection that is the same as the angle of incidence. In other words, there is no scattering of the light to different angles of reflection. Specular surfaces may have high total reflectivity, but there is no direct correlation between these two parameters. For example, a highly specular surface may absorb quite a lot of the incident light. To measure specularity it is necessary to limit the light measured at the detector to that which is at or very close to the true specular angle. A deviation from the specular angle of 2 degrees from the true specular angle is sometimes used for this measurement.

Diffuse reflectance describes light that is not reflected at the specular angle and such surfaces are said to be matt. These surfaces scatter the incident light to many different angles of reflection. A simple definition of diffuse reflectance is that it is the total reflectance less the specular reflectance. To quantify the true diffuse nature of a flat surface it would be necessary to measure the reflected light at all the possible angles of reflection. In practice only selected angles are generally used.

GB-A-718024 relates to a method of chemically treating aluminium surfaces for the purpose of increasing their specularity.

U.S. Pat. No. 2,847,286 relates to a method of forming a glossy (specular) surface on an aluminium body which includes treatment with an aqueous solution containing as active ingredients nitric acid, hydrofluoric acid and lead ions. The use of lead ions is essential to the process disclosed. A batch process is used.

JP-A-05112900 discloses the etching of the surface of an aluminium sheet with the use of an electrolyte which is an aqueous neutral salt solution. The invention disclosed relates to a lithographic sheet.

It is an object of the present invention to provide a method of improving the total reflectance of a surface of an aluminium alloy which does not involve treatment with a high viscosity fluid.

The invention provides a method of producing a reflector sheet, which method comprises treating a continuous Al alloy sheet to increase the total reflectance of a surface of the sheet to a value of at least 85% by bringing the sheet at a speed of at least 50 m/min into contact with an acid or alkaline fluid that dissolves aluminium metal, said fluid having a viscosity of less than 0.01 Pa·s, wherein from 10 nm to 2000 nm of metal is removed from the surface, and cutting or forming the treated Al alloy sheet into the shape of a reflector sheet.

The invention also provides a reflector sheet formed by the method, wherein the surface has a total reflectance of at least 85%.

According to a further aspect of the present invention, there is provided the use of a treated Al alloy sheet as a reflector sheet, wherein the treated sheet is formed from a continuous Al alloy sheet by bringing the sheet at a speed of at least 50 m/min into contact with an acid or alkaline fluid that dissolves aluminium metal, said fluid having a viscosity of less than 0.01 Pa·s, wherein from 10 nm to 2000 nm of metal is removed from the surface and the total reflectance of a surface of the sheet is increased to at least 85%.

According to a further aspect of the present invention, there is provided a method of producing a reflector sheet, which method comprises treating an Al alloy sheet to increase the total reflectance of a surface of the sheet to a value of at least 85% by treating the sheet with an acid or alkaline fluid that dissolves aluminium metal, wherein from 10 nm to 2000 nm of metal is removed from the surface, and cutting or forming the treated Al alloy sheet into the shape of a reflector sheet.

Preferably, no more than 1500 nm is removed. More preferably no more than 1000 nm is removed, and even more preferably no more than 500 nm is removed. A preferred range is 20 nm to 500 nm. The smaller amounts are preferred for processing reasons.

For environmental reasons, heavy metals (and in particular, lead) are excluded from the treatment process. In addition hydrofluoric acid, if it is present, should preferably be present in amounts not greater than 500 ppm.

The treatment involves the use of a non-viscous acid or alkaline fluid, with or without the imposition of an applied potential, which dissolves the surface. It might have been anticipated that such solutions would etch the surface and make it rougher which would increase diffuse reflectance and, because of multiple surface reflections, reduce total reflectance. However, the inventors have found that low levels of metal dissolution can lead to a significant increase in total reflectance. There follows a tentative and partial explanation of this surprising technical effect.

For metals having comparable surface cleanliness and comparable surface roughness, total reflectance (TR) is largely determined by chemical composition. As previously noted, pure aluminium has a very high TR. However the TR is reduced for untreated alloys due to the presence of second phase constituents and solid solution elements at the surface. Absorption/reflection probably takes place within a surface layer to about 20 nm thick. A perfectly flat surface absorbs light in an ideal manner depending on chemical composition. However light may undergo multiple absorption/reflectance events before it can escape from rough surfaces, thus reducing the TR.

Additionally, rolled surfaces have disturbed surface microstructures which may include fine grains with grain boundary segregated species, sub surface residual lubricant, and sub surface oxides. It is expected that all these may perturb the optical properties of the surface. Thus the removal of these disturbed layers would be expected to increase the TR. However, it is also known that as an aluminium alloy surface is dissolved, solid solution elements which are less reactive than aluminium accumulate in a thin layer at the surface. The amount of accumulation depends on the composition of the alloy and the extent of dissolution. But at the dissolution levels contemplated in the prior art, this accumulation of surface contaminant can have a major and adverse effect on TR.

Furthermore, dissolution of aluminium alloy surfaces is not generally uniform. This depends on microstructural and composition features. Grains of different orientation may dissolve at different rates. Grain boundaries or fortuitous scratches may be active sites for preferential dissolution. Second phase particles can set up microgalvanic corrosion cells. These non-uniformities lead to varying degrees of surface roughness. Thus, excessive metal dissolution is liable to increase the surface roughness which may limit the TR achievable.

The main use of the products of this invention will be for reflector sheet used where high reflectance of electromagnetic radiation is required i.e. visible light or light close to the visible range for example infra red light. Such products include lighting reflectors, and particularly the construction of louvres for indoor ceiling units. Similar applications may include solar receptors where efficient capture of sunlight by an absorber to which it is directed by reflecting surfaces is important. The product may have application for decorative effects on packaging products such as beverage cans. Also, there are expected to be other applications where low energy absorption by aluminium surfaces is critical, e.g. laser processes and high temperature applications.

The Al alloy is preferably of the AA1000 or AA3000 or AA5000 or AA6000 series (of the Aluminium Association Register), and certain of the M8000 series alloys may be appropriate, such as for example AA8006. The maximum purity of the starting aluminium is preferably 99.85%. However, an advantage of the invention is that it is possible to use a less pure, less expensive starting aluminium having better mechanical properties than was previously possible, for example AA1200 (Al greater than 99.2%) or AA1050 (Al greater than 99.5%) or even a recycled alloy of type AA3105. The Al alloy sheet is generally a rolled sheet. Preferably, the sheet is cold rolled, and possibly annealed, before any treatment with the solution. As well known in the art, rolling conditions may be chosen to produce a bright finish or a semi-bright finish. According to the invention, even mill finish is useable. One useful technique is pack rolling, in which (for example) two sheets are passed together through the nip of the roller, resulting in two rolled sheets each having a smooth surface (that came in contact with a surface of the roller) and a pack rolled surface. It is of course possible to pack roll more than two sheets simultaneously, in which case all internal sheets will have two pack rolled surfaces. As discussed below in more detail, it has surprisingly been found that pack rolled surfaces, which are generally matt, nevertheless have a higher TR than the bright surfaces.

The surface, generally a rolled surface, may need to be cleaned to remove surface contaminants particularly rolling lubricant. Then the surface is subjected to the action of an acid or alkaline fluid having a viscosity of less than 0.01 Pa·s. preferably 0.005 Pa·s. This viscosity is measured at the temperature of use, generally an elevated temperature. Viscosities at ambient temperature are correspondingly higher, e.g. up to 0.4 Pa·s. preferably up to 0.2 Pa·s. A low viscosity at the temperature of use permits the treating solution to be quickly and easily removed from the treated surface.

It is preferred that the total concentration of dissolved species in the treating solution is below 40% by weight.

The Al sheet is brought into contact with the acid or alkaline fluid at a speed of at least 50 m/min. Speeds greater than 50 m/min are suitable for the low viscosity acid or alkaline fluid with which this invention is concerned; but they are not suitable with viscous fluids such as those conventionally used for brightening or polishing. Treatment speeds of greater than 50 m/min up to 600 m/min or even more may be achieved in existing equipment for the continuous treatment of rolled sheet. Contact with the acid or alkaline fluid may be effected by passing the sheet through a spray of the fluid or more usually by passing the sheet through a bath containing the fluid, said bath being of a length chosen in relation to the speed of movement of the sheet to provide a suitable contact time, preferably less than 30 seconds, for example less than 20 seconds, preferably less than 10 seconds, for example 0.1–5 seconds. In a preferred embodiment, the method of the invention is carried out as a single step treatment.

A wide range of acid or alkaline solutions can be used. Sulphuric acid is effective, and small additions of hydrofluoric acid may be made to facilitate dissolution—this is the basis of the Ridolene systems used in the examples. Phosphoric acid is effective when used under conditions to clean rather than to anodise the surface. Caustic soda is effective and as in the examples below may be used in conjunction with sodium nitrate. Preferably the aluminium concentration is kept low enough to prevent an undue increase in the viscosity, for example below about 150 g/l, preferably below 120 g/l. These solutions are collectively known as etching cleaners or etchers, terms which imply roughening in contrast to the smoothing effect of brightening or polishing solutions. These solutions are capable of roughening Al alloy surfaces and so reducing the TR; but are used under conditions to effect a low level of dissolution required to increase TR; and at a rate compatible with the economic operating speeds of available equipment. Clearly increasing solution concentration or temperature will increase the dissolution rate. Similarly electrolytic treatments will work faster than simple chemical dissolution. A feature of the present invention is that conditions are chosen to remove so little metal that any matting effect does not reduce the TR of the surface.

Specifically, the method is performed to remove from 10 nm to 2000 nm, preferably 20 nm to 500 nm, of metal from the surface. Metal removal may conveniently be measured by gravimetric means, which gives an average over the whole surface, using the density of the aluminium alloy. This ignores any influence that entrained oil or oxide or other impurities may have. Account may need to be taken of any non-metallic material, e.g. oxide or hydroxide or oil on the surface. The starting weight, in the gravimetric determination, is obtained on a fully degreased surface so that undue influence from the presence of grease or rolling oils is eliminated. For example the surface may be cleaned with acetone or another suitable solvent or cleaner that does not dissolve aluminium. Surface oxide may, where necessary, be removed by cleaning in a solution of chromic/phosphoric acid before the gravimetric determination is made. Metal removal may be by chemical dissolution, or may be electrochemically assisted e.g. by applying an AC or DC potential with the Al alloy product as the anode. The AC potential may be of any selected wave form known in the art, for example sinusoidal or pulsed in any convenient manner. The AC potential may be biased in either a positive or a negative direction. Because very little metal is removed, a contact time between the fluid and the surface may be rather short, for example less than 20 seconds and even under some circumstances less than 1 second. Such contact times lend themselves readily to continuous treatment. After a desired contact time has elapsed, the surface may be washed, and it is an advantage of the invention that the low viscosity of the acid or alkaline fluid makes its removal quick and easy.

The concentration and the temperature of the acid or alkaline fluids, as well as the extent of agitation and other reaction conditions, may be adjusted together with contact time to achieve a desired degree of metal removal. The theoretical maximum TR for an aluminium metal surface is about 91 to 92%. The lighting industry generally requires that surfaces to be used for lighting reflectors have a TR of at least 80% preferably at least 85%. Aluminium surfaces are soft and easily scratched, and so may require a coating for protection from superficial damage during service. Alternatively, the surface can be left unprotected in certain applications, for example indoor lighting reflectors. There is a large volume of literature on organic and inorganic protective coatings on aluminium alloy surfaces to be used for lighting reflectors. An anodic aluminium oxide coating can readily be formed on the surface, but this reduces the TR by about 5–6%. Organic or inorganic lacquers can be applied to protect the metal surface, but these also reduce the TR. It is therefore desired that a method of treating an aluminium alloy surface should increase its TR to at least about 90%. Given a suitable substrate surface, existing commercial methods e.g. based on Phosbrite 159 are capable of doing that. As shown in the examples below, the method of the present invention is also capable of doing that, but without many of the disadvantages to which the existing commercial technology is subject.

Rolled sheet including pack rolled sheet generally has surface markings extending longitudinally or transversely to the rolling direction. It has been thought that etching after-treatments should be sufficient to obliterate those directional markings, so that the treated sheet has isotropic optical properties. That is part of the reason why existing etch treatments are designed to remove so much surface metal. The present inventors have determined that a degree of surface optical anisotropy need not be detrimental, from a technical or an aesthetic viewpoint. Thereby they have been enabled to remove only small amounts of metal from the Al surface, without necessarily obliterating directional markings that resulted from rolling, but also without encountering the problems to which conventional smoothing etch treatments are subject.

The specular gloss and the roughness are properties of a surface that are to some extent associated. The specular gloss of sheet used in lighting reflectors is important from an aesthetic standpoint, and different manufacturers have different requirements. The chemical/electrochemical treatments with which this invention is concerned may decrease the specular gloss of the starting surface. In any case, the treatments do not significantly increase the specular gloss. The chemical/electrochemical treatment usually increases the roughness of the surface. It is rather surprising that this increase in roughness can be accompanied by an increase in total reflectance.

The treated sheet may be cut or formed into the shape of a lighting reflector.

The following examples illustrate the invention. Treatment conditions in laboratory experiments are designed to mirror those that would be used in plant treatment of continuous coil.

Data relevant to the following examples is as follows: Phosbrite 159 (73% phosphoric acid, 12% sulphuric acid, 6% nitric acid, 8% water): 50 cp (0.05 Pa·s) at 20° C. Using the Bohlin viscometer it was measured as 22 cp (0.022 Pa·s) at 100° C.

Ridolene: Bohlin viscometer measurement 4 cp (0.004 Pa·s) at 60° C. Book values: water at 60° C.—0.734 cp (0.000734 Pa·s), water at 20° C.—1.002 cp (0.001 Pa·s).

Book values: concentrated sulphuric acid at 20° C.—24.8 cp (0.0248 Pa·s), at 0° C.—50 cp (0.05 Pa·s).

Ridolene 124 made up at 10 ml/l contains about 3.3 ml/l sulphuric acid. A further 9.8 ml/l sulphuric acid is added to increase the total sulphuric acid concentration by a factor of 4.

Ridolene 120E made up at 2 ml/l gives a free fluoride concentration of 25 ppm in the bath, which operates normally at 60° C.

EXAMPLE 1

Samples of bright rolled 1060 sheet were variously treated. TR, gloss, metal dissolution were measured. The conditions and results are given in Table 1 below. Phosbrite 159, Minco, and Ridolene are proprietary formulations for chemical brightening, degreasing and cleaning respectively. The metal dissolution is expressed as a distance into the surface, which was determined from gravimetric data, and is thus an average over the whole surface.

TABLE 1

| TREATMENT | TIME | % TR | METAL DISSOLUTION (nm) |
|---|---|---|---|
| None | | 79.2 | 21 |
| Mechanical polish + acetone degrease | | 71.1 | |
| $CrO_3/H_3PO_4$ | 30 min | 86.4 | |
| Minco degrease | 10 min | 82.3 | |
| Phosbrite 159 | 2 min | 90.1 | |
| 10 ml/l Ridolene 124, | 10 s | 88.5 | 37 |
| 2 ml/l Ridolene 120E, | 20 s | 90.9 | 56 |
| 9.8 ml/l $H_2SO_4$, 60° C. | 30 s | 88.0 | 102 |
| 20% $H_3PO_4$, | 1 s | 86.5 | 200 |
| 3000 A/m$^2$ac, 90° C. | 3 s | 90.5 | 300 |
| | 5 s | 88.0 | 350 |
| 5% NaOH/4% | 5 s | 86.4 | 35 |
| $NaNO_3$/100 g/l Al | 10 s | 87.3 | 70 |

Results for the bright rolled surface are given for comparison. Mechanical polishing alone appears to degrade the surface compared to the bright rolled condition.

There are also a series of other comparisons. The $CrO_3/H_3PO_4$ process dissolves any surface oxides but not the substrate metal, and thus has negligible smoothing capability. This process increases TR, but does not affect specularity and roughness. This suggests that the presence of surface oxide affects TR. The Minco degrease is also non-etching. Results show the same trends as for the $CrO_3/H_3PO_4$ solution.

The Phosbrite treatment significantly increased the TR, as expected.

The Ridolene and ac $H_3PO_4$ process gave an increase in TR which may be as great as achieved using the conventional technology, Phosbrite.

The results for the alkaline etch, Ridolene and ac $H_3PO_4$ processes indicate that, by appropriate choice of (electro-) chemical treatment, surfaces with high TR can be achieved. It should be noted that the average amounts of metal removed by these processes vary considerably, which is surprising given the expectation that the success of these processes depends on the removal of a disturbed layer.

EXAMPLE 2

The inventors have measured the TR of pack-rolled AA1050A sheet both on the matt and bright surfaces, and again after a 20 s Ridolene treatment. The samples were obtained from trials where 30, 40 and 50% thickness reductions were achieved by the pack-roll pass. The matt surface after the 50% reduction was substantially non-directional. The TR results are in Table 2 below. Note that there are duplicate results for a 50% reduction.

TABLE 2

| % REDUCTION ON PACK ROLLING | SIDE OF STRIP | % TR | % TR AFTER SUBSEQUENT RIDOLENE |
|---|---|---|---|
| 50 | Matt | 86 | 87 |
| 50 | Bright | 78 | 83 |
| 50 | Matt | 81 | 88 |
| 50 | Bright | 75 | 82 |
| 40 | Matt | 77 | 85 |
| 40 | Bright | 69 | 78 |
| 30 | Matt | 76 | 82 |
| 30 | Bright | 69 | 77 |

Rather surprisingly, it was found that the matt surfaces have a higher total reflectance than the bright surfaces. Also, it appeared that higher values were achieved by greater reductions. Further benefits arose from the Ridolene treatments.

TR measurements were made on a series of pack rolled samples of AA1050A sheet. Here, there were reductions of 30 to 90% on the first pass, followed by interannealing at 200° to 500° C., with final pack rolling reductions of 35 or 50%. The TR results from the matt surfaces are given in Table 3 below. The results shown in both Tables 3 and 4 were also taken after the cleaning process with Ridolene for 20 s.

The data shows that a TR up to 91–92% can be achieved; this is the theoretical maximum level for aluminium. It appears that the optimum conditions to achieve a high TR are a 73% first pass reduction, interanneal no higher than 450° C., and a 50% reduction on pack rolling.

TABLE 3

| TEMP, ° C. | FIRST PASS REDUCTION, % 30 PACK ROLL REDUCTION, % 35 | 50 | 50 PACK ROLL REDUCTION, % 35 | 50 | 73 PACK ROLL REDUCTION, % 35 | 50 | 90 PACK ROLL REDUCTION, % 35 | 50 |
|---|---|---|---|---|---|---|---|---|
| 200 | 87 | 90 | 87 | 90 | 89 | 91 | 88 | 88 |
| 320 | 79 | 82 | 89 | 90 | 88 | 90 | 84 | 91 |
| 400 | 86 | 85 | 89 | 91 | 92 | 90 | 86 | 89 |
| 450 | 87 | 88 | 89 | 91 | 91 | 91 | 83 | 86 |
| 500 | 78 | 84 | 74 | 82 | 89 | 89 | 82 | 81 |
| 550 | 73 | 77 | 76 | 74 | 88 | 83 | 84 | 83 |

Variations in specularity also arose. Table 4 below gives the 20° gloss values on the pack-rolled (matt) surfaces.

TABLE 4

| TEMP, ° C. | FIRST PASS REDUCTION, % 30 PACK ROLL REDUCTION, % 35 | 50 | 50 PACK ROLL REDUCTION, % 35 | 50 | 73 PACK ROLL REDUCTION, % 35 | 50 | 90 PACK ROLL REDUCTION, % 35 | 50 |
|---|---|---|---|---|---|---|---|---|
| 200 | 16.8 | 13.6 | 22.9 | 16.5 | 17.9 | 17.8 | 49.2 | 39.4 |
| 320 | 11.9 | 10.3 | 13.7 | 11.6 | 11.5 | 11.1 | 25.8 | 15.9 |
| 400 | 12.6 | 11.5 | 14.5 | 11.4 | 13.5 | 9.5 | 21.4 | 14.9 |
| 450 | 12.7 | 10.2 | 16.2 | 12.8 | 12.5 | 9.6 | 21.1 | 12.3 |
| 500 | 12.0 | 10.6 | 10.4 | 9.9 | 11.3 | 8.9 | 17.8 | 10.0 |
| 550 | 9.6 | 8.5 | 8.5 | 6.8 | 14.9 | 10.2 | 31.5 | 15.4 |

The gloss values indicate a diffuse reflector. It appears that the best diffuse reflectors were given by a 30% first pass reduction, an interanneal at about 500° C., and a 50% pack rolling reduction. Thus, to some extent the conditions for high total reflectance and low gloss coincide.

EXAMPLE 3

Some of the brightened examples were exposed indoors for some months: the change in Total Reflectance was as follows:

Total Reflectivity (TR) on Office Exposed Sheets

The samples exposed for 8 months were:

1. AA1060 bright rolled commercially produced material+20 s Ridolene: Original 89% TR, 8 months 87% TR
2. AA1060 as rolled: Original 82% TR, 8 months 79% TR
3. AA1050A+20 s Ridolene: Original 88% TR, 8 months 88% TR
4. AA1050A treated electrolytically in phosphoric acid: Original 83% TR, 8 months 84% TR
5. AA1050A pack rolled+20 s Ridolene: Original 88% TR, 8 months 87% TR The results of these tests show that the high total reflectivity achieved by applying methods of this invention is sustained over an extended period of time without significant degradation in performance.

The invention claimed is:

1. A method of producing a reflector sheet, which method comprises treating a continuous Al alloy sheet to increase the total reflectance of a surface of the sheet to a value of at least 85% by bringing the sheet at a speed of at least 50 m/min into contact for less than 30 seconds with an acid or alkaline fluid that dissolves aluminium metal, said fluid having a viscosity of less than 0.01 Pa·s, wherein from 10 nm to 2000 nm of metal is removed from the surface, and cutting or forming the treated Al alloy sheet into the shape of a reflector sheet.

2. The method as claimed in claim 1, wherein from 20 nm to 500 nm of metal is removed from the surface.

3. The method as claimed in claim 1, wherein the Al alloy is a AA1000 or AA3000 or AA5000 or AA6000 or AA8000 series alloy.

4. The method as claimed in claim 1, wherein the sheet is pack rolled sheet, a matt surface of which is subjected to the action of the acid or alkaline fluid.

5. The method as claimed in claim 1, wherein the surface of the sheet is subjected to electrolysis in the presence of the fluid.

6. The method as claimed in claim 1, wherein the treated surface is given a protective organic or inorganic coating.

7. The method of claim 1, wherein the treated Al alloy sheet is cut or formed into the shape of a lighting reflector.

8. A method of producing a reflector sheet, which method comprises treating an Al alloy sheet to increase the total reflectance of a surface of the sheet to a value of at least 85% by treating the sheet with an acid or alkaline fluid that dissolves aluminium metal for less than 30 seconds, wherein from 10 nm to 2000 nm of metal is removed from the surface, and cutting or forming the treated Al alloy sheet into the shape of a reflector sheet.

* * * * *